US005515763A

United States Patent [19]

Vandervoort

[11] Patent Number: 5,515,763

[45] Date of Patent: May 14, 1996

[54] TACTILE KEY TOPS

[76] Inventor: Paul B. Vandervoort, 2875 Idlewild Dr., #19, Reno, Nev. 89509

[21] Appl. No.: 173,855

[22] Filed: Dec. 22, 1993

[51] Int. Cl.[6] ..... G10C 3/12

[52] U.S. Cl. ..... 84/433; 84/437; 400/483

[58] Field of Search ..... 84/427, 429, 433, 84/437; 400/490, 491, 494, 483, 488

[56] References Cited

U.S. PATENT DOCUMENTS

| | | | |
|---|---|---|---|
| 229,365 | 6/1880 | Black | 84/423 R |
| 726,107 | 4/1903 | Stanton | 400/490 |
| 771,950 | 10/1904 | Voges | 400/490 |
| 1,201,769 | 10/1916 | Siegel | 84/423 |
| 2,195,238 | 3/1940 | Cervenka | 84/433 |
| 2,203,393 | 6/1940 | Reuther | 84/428 |
| 2,706,926 | 4/1955 | Young | 84/451 |
| 4,565,460 | 1/1986 | Kline | 400/490 |
| 5,396,023 | 3/1995 | Pye | 84/433 |

FOREIGN PATENT DOCUMENTS

| | | | |
|---|---|---|---|
| 320203 | 2/1903 | France | 84/479 A |

OTHER PUBLICATIONS

Sack; *Remarks Concerning a Keybboard Surface* Musical Six–Six Newsletter; Issue #11, pp. 2, 3 1974.

Howe; *T.O. on the Howe–Way 6–6 Kybd.* Musical Six–Six Newsletter; Issue #33, pp. 18, 19 1984.

Vandervoort; *System For Tactile Orientation* Musical Six–Six Newsletter, 1984, Issue #33, pp. 15–17.

De Vries (no title) *Musical Six–Six Newsletter*; 1985, Issue #35, p. 1.

Mutoh; Promotional Brochure for Rapian Keyboard; Kanpei Mutoh, inventor 1989.

*Primary Examiner*—Patrick J. Stanzione

[57] ABSTRACT

The invention applies to keyboards—for example, musical or typewriter keyboards. Various key top shapes are disclosed which may be identified by touch. These shapes include longitudinal ridges, slots, and rows of ridges, slots, knobs, craters and texturing. Various angled key tops are disclosed also. The preferred embodiment applies to a musical keyboard similar to the Janko design.

17 Claims, 3 Drawing Sheets

TACTILE KEY TOPS

BACKGROUND

1. Field of the Invention

This invention relates to tactile key tops for the keys of finger-operated devices such as keyboard musical instruments, typewriters, calculating machines, stenography machines, etc.

2. Description of the Prior Art

Oftentimes, keyboard operators, or performers, have a need or desire to operate their keyboards while looking elsewhere. For example, clerical personnel have text or accounting records to transcribe, and musicians have sheet music or other sights to watch. Furthermore, visually impaired persons may not have the option of looking at their keyboards at all.

With many types of keyboards, including typewriter and musical keyboards, most or all fingers are required to operate more than one key. For example, each index finger is typically used to operate six or more keys on a typewriter. On a musical keyboard, each finger may, over the course of a performance, operate dozens of keys. Without visual assistance, it is sometimes difficult to accurately change finger or hand position. To aid in orientation while the fingers are changing position, various tactile orientation systems have been proposed in the prior art.

French Patent #320,203 (Laudenbach) discloses a piano keyboard with a different tactile key top texture for each of the twelve notes within each octave. One positive aspect of this arrangement is that it allows the musician to identify any of the twelve notes without reference to any other notes.

Other prior art disclose various tactile key tops. However, twelve different tactile key tops which, when used together, satisfy the criteria outlined below have not been found in the prior art.

OBJECTS OF THE INVENTION

Objects of the invention include:

To provide tactile key tops which are easily and quickly distinguishable from each other by touch;

To provide tactile key tops which allow the operator to easily and comfortably slide his or her finger forward and off the key;

To provide at least some tactile key tops which tend to steer the operator's finger toward the longitudinal centerline of the key;

To provide tactile key tops which are easy to clean;

To provide tactile key tops which are mostly smooth, and therefore pleasant to the touch, particularly along the longitudinal centerline of the key, and;

To provide tactile key tops which are elegant, i.e., conceptually simple in design.

SUMMARY OF THE INVENTION

Accordingly, various tactile key top shapes are provided.

One shape includes a ridge extending longitudinally, i.e., from front to rear, along at least a portion of the length of the key top substantially adjacent one side surface of the key. The top edge of the ridge is rounded, to enhance fingertip comfort. A second ridge, symmetrical with the first, may also be included on the other side of the key top opposite the first ridge.

Another shape also includes a longitudinal ridge substantially adjacent one side surface of the key. Adjacent the side of the ridge opposite the side surface, the key top includes a substantially planar surface. To allow the operator's finger to easily and comfortably slide forward off the key, this surface extends substantially from the rear end of the key top to the front edge of the key top. A second ridge, symmetrical with the first, may also be included on the other side of the key top opposite the first ridge. These ridges may be rounded to enhance fingertip comfort, as described above, or may be flat-topped. Examples of keys with ridges of this type are shown in FIGS. 1–6 & 28.

Another shape also includes a longitudinal ridge. To allow comfortable forward and sideways sliding of the finger off either of the front key top corners, the ridge diminishes in height or is elliminated altogether in an area of the key top aligned with the ridge and adjacent the front edge. Two such ridges, symmetrical with each other, may be provided, one adjacent each side surface of the key. The key top may incorporate a planar surface in the center from front to rear, as described above. Examples of keys of this type are shown in FIGS. 5 & 6. Alternately, the key top rearward of the front area may be covered with a multiplicity of uniformly spaced longitudinal ridges. These ridges may be flat-topped, sharp-edged, or rounded as described above to enhance fingertip comfort. An example of a key of this type is shown in FIGS. 7 & 8.

Another shape includes a non-linear section extending longitudinally along at least a portion of the length of the key top substantially adjacent at least one side surface of the key. A non-linear section is defined in this specification and appended claims as a section of the key top which includes at least two height variations along a longitudinal axis; i.e., a series of key cross-sections taken along parallel planes perpendicular to the longitudinal key axis representing the entire key length will be non-identical in the area of the non-linear section. Examples of keys with non-linear sections adjacent each side surface are shown in FIGS. 9–17.

Another shape comprises an improved form of a key top with multiple longitudinal ridges. It has been found that a key with longitudinal ridges over the entire key top suffers from a drawback when applied to a Janko Keyboard. When a fingertip strikes this key and is then slid forward to slide off the key and strike another key in the next lower row one half-step above or below, the ridges in the key top tend to prevent the fingertip from moving sideways as desired to strike the selected lower key. The improved shape of the present invention includes at least one ridge on each side of the key top. Each ridge extends longitudinally from the rear end of the key top to a longitudinal position on the key top and then turns to its corresponding side forward of the longitudinal position. This turn may be accomplished gradually, i.e., via a curve; sharply, i.e., via an angle; or via some combination of curve and angle. The purpose of the turned sections is to guide the fingertip to one side or the other when the fingertip is brought forward. The longitudinal position where the turn begins is located a substantial distance from both the front and rear ends of the key top. An example of a key of this type is shown in FIG. 18.

Another shape includes a key top with gentle texturing. Gentle texturing is defined in this specification and appended claims as a regular or random tactile pattern with surface angles of 30 degrees from horizontal or less. An example of a key with gentle texturing is shown in FIGS. 19 & 20.

Another shape includes a key in which at least a portion of the key top extending substantially from one side to the other is angled on a longitudinal axis relative to the axis of its key row. Examples of keys of this type are shown in FIGS. 21–25.

Another shape includes a key top which is angled on a lateral axis with respect other key tops in the same row. An example of a key of this type is shown in FIG. 26.

Another shape includes a key top which is arcurate and convex on a lateral axis. An example of a key of this type is shown in FIG. 27.

Another shape includes a substantially flat section extending longitudinally along the center of the key top, a longitudinal slot on one side of the key top and a longitudinal ridge adjacent the bottom of the slot. The slot is disposed between the ridge and the flat section. A second slot and ridge may be provided on the opposite side of the key top. An example of a key of this type is shown in FIGS. 28 & 29.

To allow the operator's finger to easily and comfortably slide forward off the key, the front edge and front corners of each of the key tops of the invention may be rounded.

ORIENTATION TERMS AND DISCLAIMER

In this specification and appended claims orientation terms are based on the orientation of a musician as most commonly positioned at a piano keyboard.

Solely for the purpose of defining orientation terms, it is presumed that each key is longer in the front-rear dimension than in the left-right dimension. Thus, the longitudinal axis of a key is that axis which extends from the front to the rear of the key. The lateral axis extends from left to right.

The invention may also be applied to keys which are longer in the left-right dimension than in the front-rear dimension. In this situation, the longitudinal axis remains defined as front-rear and the lateral axis remains defined as left-right.

The key top is the surface of the key which is normally struck by the operator's fingertip to impart key movement.

A side surface is a surface on the left or right side of the key.

Solely for the purpose of defining orientation terms, it is presumed that the movement of each key is vertical. Thus, references to elevation are to be taken along the axis of key movement, not necessarily along the axis of gravitational force.

These orientation terms are intended only to convey the placement of the various parts and elements in relation to each other and to facillitate description. They are not intended to convey any limitation on the placement of the keyboard in relation to the direction of gravitational force or to the physical position of the operator. The invention and the preferred embodiment may be tilted on any horizontal axis to any angle or upside down and may still function as intended. An example of an alternative angle application is an accordion.

BRIEF DESCRIPTION OF THE DRAWINGS

All drawing figures show keys according to the invention or which may be employed with the invention.

DESCRIPTION OF THE PREFERRED EMBODIMENT

The preferred embodiment comprises an application of the present invention to the Janko musical keyboard. This keyboard is described in U.S. Pat. No. 360,255 and others. The preferred embodiment may also apply to modified Janko keyboards (e.g., ones with five rows instead of six) or to non-Janko keyboards.

FIGS. 1 through 33 show various key tops which may be used in the preferred embodiment.

Figure 1:
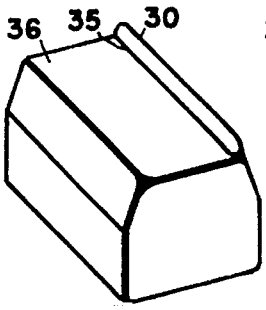
FIGS. 1–3, 5–7, 21–28, 30 & 32 show perspective views of keys. The view of each of these keys is from above, to the left, and in front.
Figure 2:
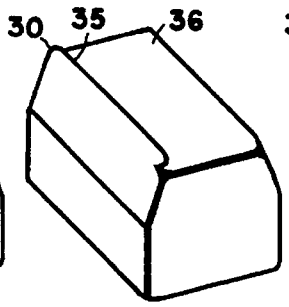
Figure 3:
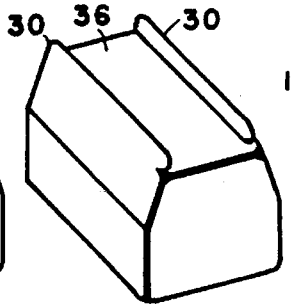
Figure 4:
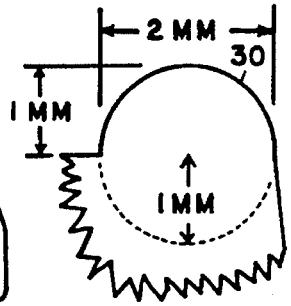
FIG. 4 shows a close-up rear view of the upper left corner of the key of FIG. 3.

FIGS. 1 through 3 show keys with ridges 30 on the right, left, and both sides, accordingly. These ridges may be rounded on the top, as shown, to enhance fingertip comfort. The lower inside corners 35 are sharp to facillitate tactile perception. A planar surface 36 extends from the rear end of the key top to the front edge of the key top. FIG. 4 shows a close-up rear view of the upper left corner of the key of FIG. 3. The height of each ridge is 1 mm. The width of each ridge adjacent the key top is 2 mm. The crosssection of each ridge is semi-circular, with a radius of 1 mm.

Figure 5:
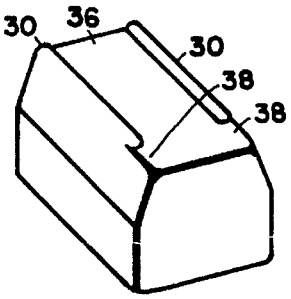
Figure 6:
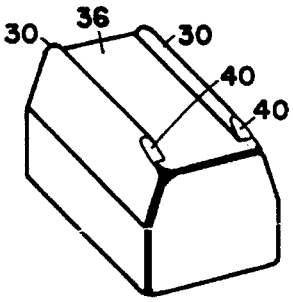

FIG. 5 shows a key similar to the FIG. 3 key, but with an area 38 in front of each ridge and adjacent the front edge. The ridge 30 is elliminated in this area. This front area is flat to enhance comfort when the fingertip is slid forward to the side and off the key to strike a key in the row below. FIG. 6 shows a variation of this feature in which each ridge 30 is reduced in height in the front area of the key top. In the embodiment shown in this drawing figure, each ridge incorporates a tapered section 40 in the front area. Alternately, the ridge may be sharply reduced in height at the rear end of the front area and constant in height within this area (not shown).

Figure 7:
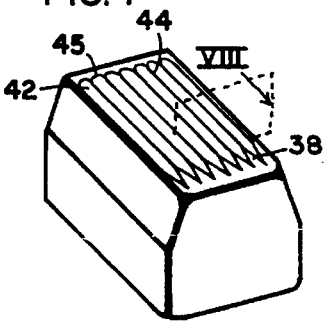
Figure 8:
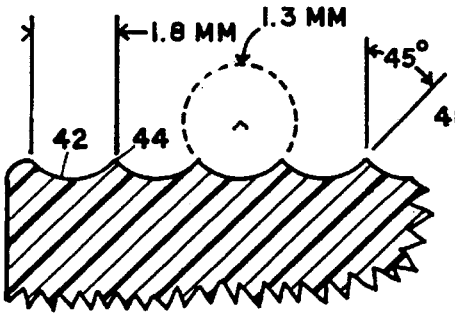
FIG. 8 shows a close-up cross-sectional view of the right side of the key of FIG. 7 as viewed from the rear taken on plane VIII of FIG. 7.

FIG. 7 shows a key with a key top covered with a multiplicity of uniformly spaced longitudinal slots 42. FIG. 8 shows a close-up cross-sectional view of the right side of this key top as viewed from the rear taken on plane VIII of FIG. 7. Adjacent slots 42 are spaced 1.8 mm apart, center-to-center. Each slot in cross-section is formed of a quarter-circle. The angle from vertical of the slot sides at the apex is thus 45 degrees. The radius of the quarter-circle is 1.3 mm.

Ridges 44 are formed between adjacent slots. To make this key top easy to identify by touch, it is recommended that the ridges 44 be sharp-edged, as shown. To prevent these sharp-edged ridges from wearing as a result of fingernail contact, it is recommended that these key tops be formed of a hard material such as epoxy or phenolic resin. Each slot 42 extends forward longitudinally from a position 45 near the rear end of the key top across the main body of the key top to a front area 38. As it extends forward across this front area, each slot is gradually reduced in depth and width and terminates near the front edge of the key top.

FIGS. 9 thru 17 show various views of keys with non-linear sections extending longitudinally on the key tops adjacent each key side. A flat area 38 is provided at the front corners of each of these key tops. This flat area is to enhance comfort when the fingertip is slid forward to the side and off the key to strike a key in the row below. Each non-linear section shown may be applied to one key side only (not shown). Another option is to apply a nonlinear section over an entire key top (also not shown).

Figure 9:
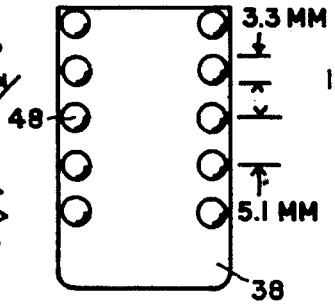
FIGS. 9, 11, 13, 16, 18 & 19 show overhead views of keys.
Figure 10:
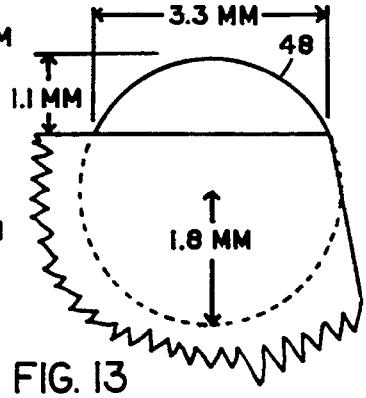
FIG. 10 shows a close-up rear view of the upper left corner of the key of FIG. 9.

The non-linear section shown on the key of FIGS. 9 and 10 comprises a row of knobs 48. FIG. 9 shows an overhead view of this key. FIG. 10 shows a close-up rear view of the upper left corner of this key. Each knob is shaped as a section of a sphere. The diameter of each knob adjacent the key top is 3.3 mm. The knobs on each side are spaced 5.1 mm apart, center-to-center. The height of each knob is 1.1 mm. Each knob is shaped as a section of a sphere with a radius of 1.8 mm.

Figure 11:
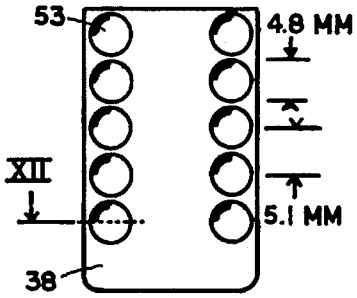
Figure 12:
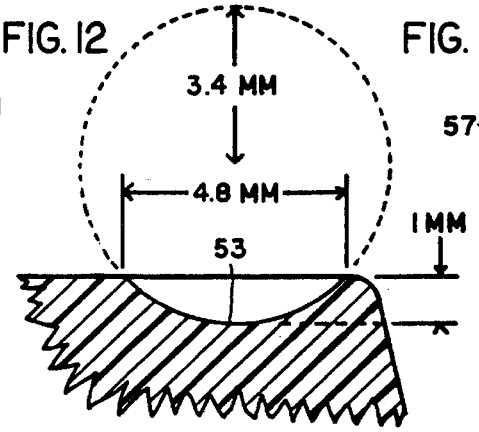
FIG. 12 shows a close-up cross-sectional view of the upper left corner of this key taken on the line XII of FIG. 11.

The non-linear section shown on the key of FIGS. 11 and 12 comprises a row of craters 53. FIG. 11 shows an overhead view of this key. FIG. 12 shows a close-up cross-sectional view of the upper left corner of this key taken on the line XII of FIG. 11. Each crater is shaped as a section of a sphere with a radius of 3.4 mm. The diameter of each crater adjacent the key top is 4.8 mm. The craters on each side are spaced 5.1 mm apart, center-to-center. The depth of each crater is 1 mm.

Figure 13:
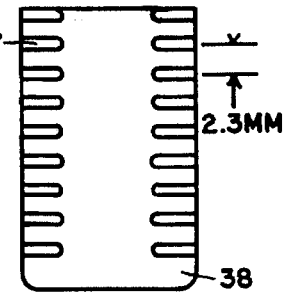
Figure 14:
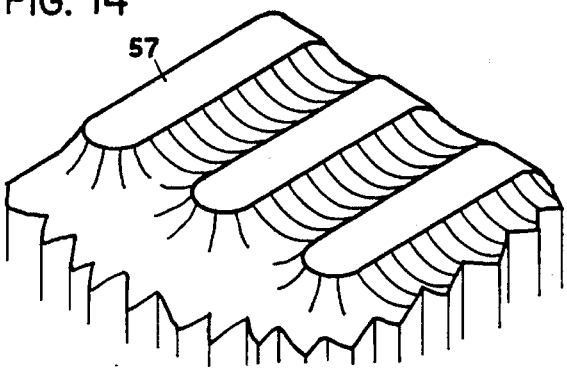
FIG. 14 shows a close-up perspective view of the upper right rear corner of the key of FIG. 13.
Figure 15:
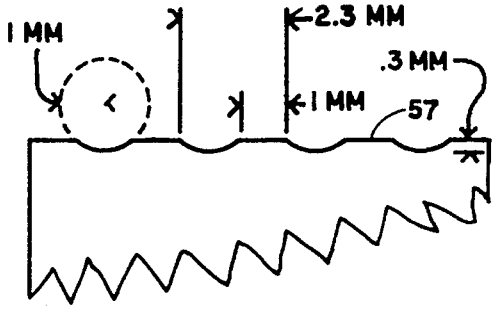
FIG. 15 shows a close-up side view of the upper left rear corner of the key of FIG. 13.

The non-linear section shown on the key of FIGS. 13 thru 15 comprises a row of ridges 57. FIG. 13 shows an overhead view of this key. FIG. 14 shows a close-up perspective view of the upper right rear corner of this key. FIG. 15 shows a close-up side view of the upper left corner of this key. Each ridge is flat-topped. The center-to-center longitudinal distance between each ridge is 2.3 mm. The width of each ridge top is 1 mm. The width of the gap between adjacent ridges is 1.3 mm. Each gap is arcurate and concave with a radius of 1 mm.

Figure 16:
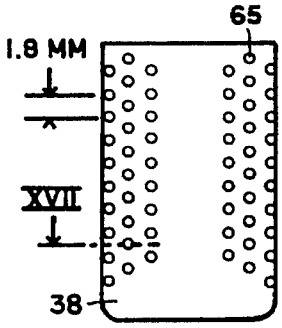
Figure 17:
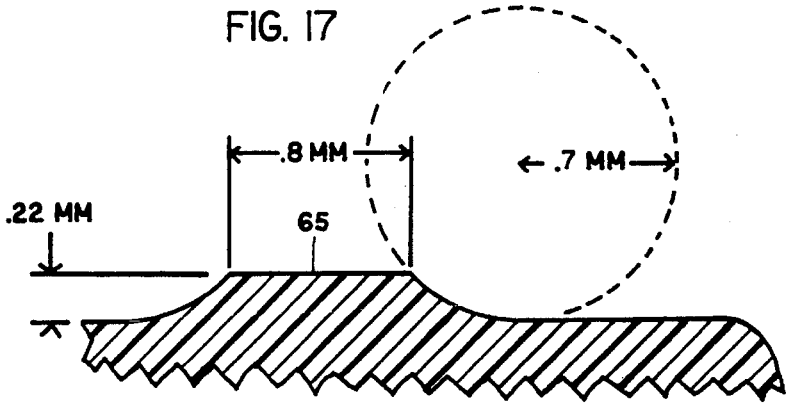
FIG. 17 shows a close-up cross-sectional side view of one of the knobs 65 taken on the line XVII of FIG. 16.

The non-linear section shown on the key of FIGS. 16 and 17 comprises a textured surface. The textured surface shown comprises a multiplicity of knobs 65 arranged in a honeycomb grid. FIG. 16 shows an overhead view of this key. FIG. 17 shows a close-up cross-sectional side view of one of the knobs taken on the line XVII of FIG. 16. Each knob 65 is 0.22 mm in height. The top of each knob is flat with a diameter of 0.8 mm. The cross-section of the side of each knob is concave with a radius of 0.7 mm. The center-to-center distance between adjacent knobs is 1.8 mm. Other textured surfaces may be employed alternately. For example, a random tactile pattern such as the "Haircell" textured finish used by Tap Plastics on their 0.09" ABS sheets may be used (not shown).

Figure 18:
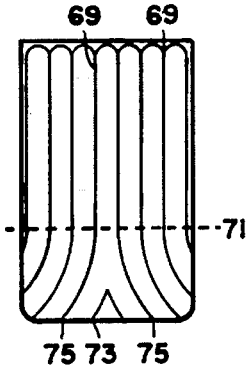

FIG. 18 shows a key top with a multiplicity of ridges. Each ridge 69 extends longitudinally from the rear end of the key top to a longitudinal position on the key top. This position is two-thirds of the key length from the rear end of the key and is shown in FIG. 18 by dotted line 71. Each ridge is positioned to one side of the longitudinal centerline of the key. The ridges 69 are shaped and spaced as those shown in FIGS. 7 & 8. Forward of longitudinal position 71 each ridge curves toward its nearest key side. One ridge 73 which is peak-shaped as viewed from above is provided on the front center area of the key between the two center diverging ridges 75. The purpose of the curved sections and the peak-shaped ridge is to guide the fingertip to one side or the other when the fingertip is brought forward. As an alternative to the preferred embodiment, the ridges forward of the longitudinal position may angle sharply, or dog-leg, rather than curve as shown. The longitudinal position where the rear straight ridge portions end is not necessarily the same for each ridge. In the dog-leg embodiment (not shown) the longitudinal position for outer ridges may be rearward of the longitudinal position for the center ridges.

Figure 19:
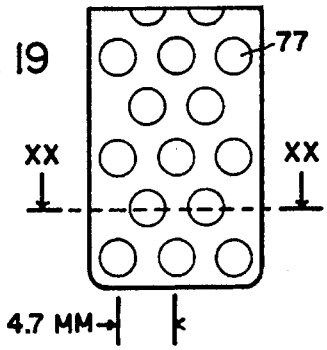
Figure 20:
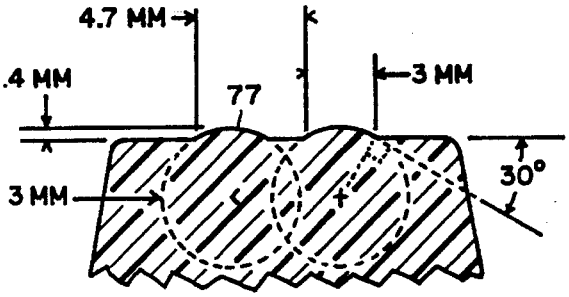
FIG. 20 is a cross-sectional view showing two knobs 17 in cross-section taken on the line XX—XX of FIG. 19.

FIGS. 19 and 20 show a key with gently textured key tops. The texturing shown is formed of a multiplicity of knobs 77 arranged in a honeycomb pattern. FIG. 19 is an overhead view of the key. FIG. 20 is a cross-sectional view of the key showing two knobs in cross-section taken on the line XX—XX of FIG. 19. Adjacent knobs are spaced 4.7 mm apart, center-to-center. These knobs are formed as a portion of a sphere with a radius of 3 mm. Each knob has a diameter of 3 mm. The angle from horizontal of the side of each knob adjacent the key top is 30 degrees. Alternately, other features may be employed for gentle texturing including craters, ridges, slots, or red, dom tactile patterns.

FIGS. 21–25 show keys in which at least a portion of each key top is angled on a longitudinal axis. Each key shown in these Figures is angled to the left. Alternately, the key top shapes shown may be angled to the right.

Figure 21:
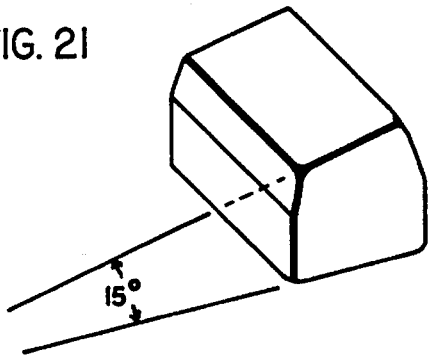

FIG. 21 shows a key with a planar key top angled 15 degrees from horizontal. The front right corner of the key top is at a higher elevation than the front left corner. Thus, if the adjacent keys of the row in front are substantially flat-topped and at a uniform elevation, a finger sliding from the angled key will travel a greater vertical distance to the right key than to the left. A vertical distance differential may also be encountered sliding from the higher row to the angled key.

Figure 22:
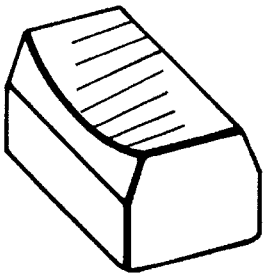
Figure 23:
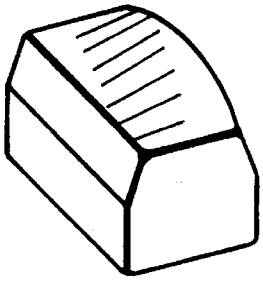
Figure 24:
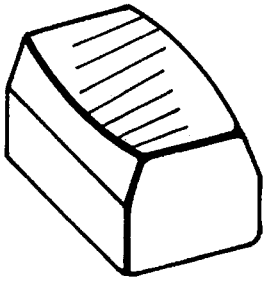
Figure 25:
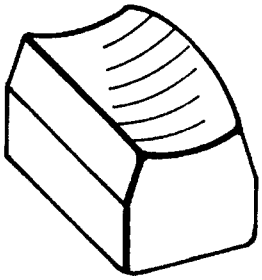

FIGS. 22–25 show keys in which the front and rear key top ends are unangled. With these unangled ends, the vertical distance differential is elliminated. With each of these keys the maximum overall key top angle from horizontal is 15 degrees. FIG. 22 shows a key in Which one side of the key top is substantially linear and the other side is concave. FIG. 23 shows a key in which one side of the key top is substantially linear and the other side is convex. FIG. 24 shows a key in which one side of the key top is concave and the other side is convex. An advantage of the FIG. 24 key is that the longitudinal centerline of the key top is linear. The keys of FIGS. 21–24 are each shaped so that a lateral straight line may be ruled on the key top at any point along the key length. Alternately, these key tops may retain the overall angles shown without the lateral straight line feature. For example, the key tops of FIGS. 21–24 may be concave. A concave version of the FIG. 23 key is shown in FIG. 25.

Figure 26:
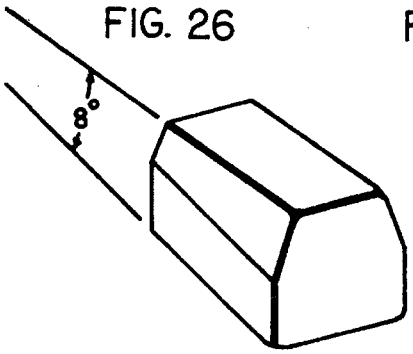

FIG. 26 shows a key with a key top which is angled rearward on a lateral axis. The angle from horizontal is 8 degrees. Alternately, the key top may be angled forward (not shown). Variations such as those applied to the FIG. 21 key in FIGS. 22–25 may also be applied to the FIG. 26 key or to a forward-angled key.

Figure 27:
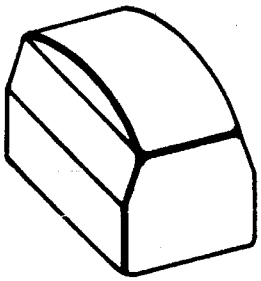

FIG. 27 shows a key with a key top which is arcurate and convex on a lateral axis. As with the concave variation of the FIG. 23 key shown in FIG. 25, the FIG. 27 key may also be modified (not shown).

Figure 28:
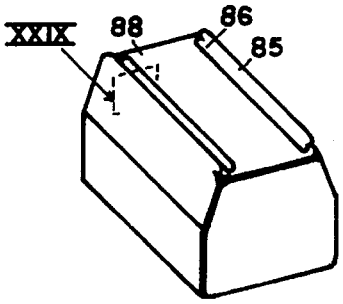
Figure 29:
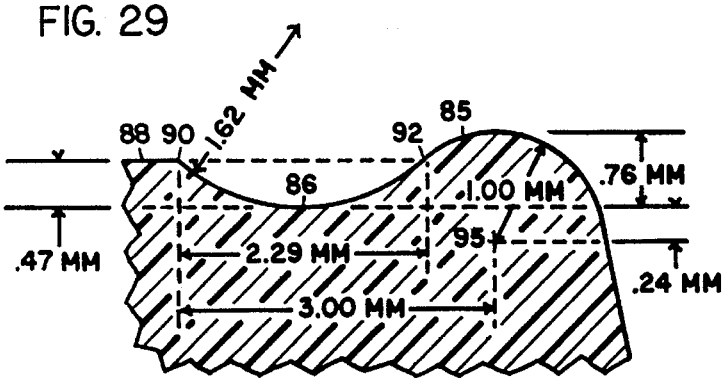
FIG. 29 shows a close-up cross-sectional view of the upper left side of the key of FIG. 28 as viewed from the rear taken on plane XXIX.

FIG. 28 shows a key with a key top incorporating a longitudinal ridge 85 and an adjacent longitudinal slot 86 on each side. FIG. 29 shows a close-up cross-sectional view of the left side of this key top as viewed from the rear. Each slot is disposed between its adjacent ridge and the flat center area 88 of the key.

The slot is defined as extending from the center area edge adjacent the slot to the peak of the ridge. The ridge is defined as extending from the bottom of the slot to the outside position of equal altitude with the bottom of the slot. Thus, the portion of the cross-sectional shape between the bottom of the slot and the peak of the ridge is common to the slot and the ridge.

The purpose of the slot 86 is to produce the inside edge 90 which may be easily felt by the fingertip. The purpose of the ridge 85 is to provide finger support when the fingertip strikes the side of the key top. In the preferred embodiment, the height of the ridge (as measured from the bottom of the slot) is greater than the depth of the slot (as measured from the center area 88). Alternately, the key according to the present invention may be engineered with the height of the ridge equal to or less than the depth of the slot, if desired.

In the preferred embodiment the slot depth is 0.47 mm and the ridge height is 0.76 mm. The cross-sections of the ridges and slots are formed of portions of circles. The slot is formed primarily of a concave portion with a radius of 1.62 mm. The ridge is formed primarily of a convex portion with a radius of 1.00 mm. The concave portion is 2.29 mm wide and 0.47 mm deep. The outside edge 92 of the concave portion is coplanar with the center area 88. The axis point 95 of the radius of the convex portion is positioned horizontally 3.00 mm from the edge 90 of the center area 88 and vertically 0.24 mm below the bottom of the slot.

Figure 30:
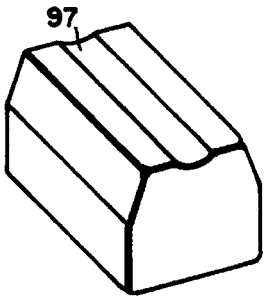
Figure 31:
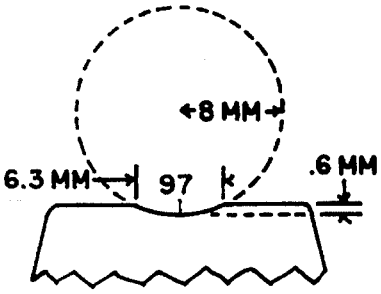
FIG. 31 shows a rear view of the key of FIG. 30.

FIG. 30 shows a key with a key top incorporating a centered longitudinal slot 97. A rear view of this key is shown in FIG. 31. The slot cross-section is formed of a portion of a circle with a radius of 8 mm. The width of the slot is 6.3 mm. The depth of the slot is 0.6 mm.

Figure 32:
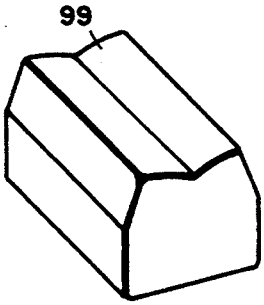
Figure 33:
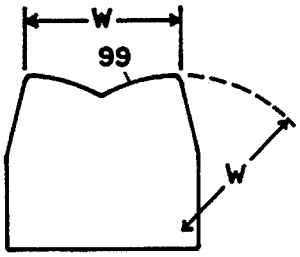
FIG. 33 shows a rear view of the key of FIG. 32.

FIG. 32 shows a key with a gentle convex ridge 99 on each side. FIG. 33 shows a rear view of this key. Each ridge cross-section is formed of a portion of a circle with a radius equal to the overall width of the key top. The longitudinal axis of each ridge radius is directly beneath the corresponding side edge of the key top. The two ridges intersect along the longitudinal centerline of the key.

NOTE ASSIGNMENT

The various key top shapes disclosed above may be assigned to the notes of the keyboard in various combinations. As with the Reuther Keyboard mentioned above, it is recommended that each of the twelve notes per octave be assigned a different tactile key top.

In addition to the objects stated above, it is an object of the preferred embodiment to provide a tactile orientation system which is easy to learn. Two ways in which this object can be achieved are:

(1) Assigning a level flat key top to the note C. This assignment is easy to remember since C is widely regarded as the note of basic harmonic origin and the level flat surface is the most basic key top.

(2) Assigning key top shapes which tend to mirror each other to notes which mirror each other on the conventional keyboard, e.g., C# & D# and/or G & A. These assignments are easy to remember since the standard black-white color assignment tends to suggest this feature. The notes D and G# are the axes of the coloring pattern.

Another object of the preferred embodiment is to assign those key tops which are the most difficult to clean to the black keys, since dirt build-up on black keys will tend to be less visible.

A further object of the preferred embodiment is to provide an arrangement of tactile key tops which allows glissandos to be performed comfortably in any key row.

The best mode contemplated by the inventor as of the filing date of this specification uses twelve key top shapes assigned to the twelve notes as follows:

C: Flat, untextured key top (not shown)

C#: A modified version of the key of FIGS. 13–15 with the ridges 57 extending unbroken from the right to left key sides. The front area remains flat as shown. This key top shape is not shown.

D: The key of FIGS. 30 & 31.

D#: The key of FIGS. 11 & 12.

E: The key of FIGS. 9 & 10.

F: A modified version of the key of FIGS. 16 & 17 with the knobs 65 covering the entire key top in a uniform hexagonal grid. The center-to-center distance between adjacent knobs is increased to 4 mm. This key top shape is not shown.

F#: The key of FIGS. 28 & 29.

G: The key of FIGS. 19 & 20.

G#: The key of FIGS. 13–15.

A: The key of FIGS. 32 & 33.

A#: The key of FIGS. 7 & 8.

B: the key of FIG. 6.

In the preferred embodiment, all key tops of the same note in all rows and all octaves are shaped identically. By limiting the key top shapes to twelve, the tactile orientation system may be learned quickly and the twelve best shapes may be used exclusively.

Alternately, the same notes in different octaves and/or different rows may be assigned different key tops. In this way, the tactile orientation system may inform the musician of octave and/or row identity in addition to note name. Similar shapes may be assigned to the same note in different rows or octaves. For example, the FIG. 18 key may be assigned to each A# in the center row and the FIG. 7 key may be assigned to each A# in the first and fifth rows.

If sideways-angled keys such as those shown in FIGS. 21–25 are used, it is recommended that symmetrical right-facing and left-facing keys be used together. For example, a left-facing key may be assigned to C# and a right-facing key to D#, or vice-versa.

The preferred shape for sideways-angled keys is shown in FIG. 22. This key may be used with a symmetrical right-facing version of itself. The FIG. 22 key is assigned to the key on the right side of the right-facing version. For example, the FIG. 22 key may be assigned to the note A and the right-facing version may be assigned to the note G. The straight sides of each key top (at rest position) are at the same elevations as the adjacent key top sides of the adjacent keys (at rest position), i.e., in the example given, the right side of A is at the same elevation as the left side of B, and the left side of G is at the same elevation as the right side of F.

A concave version of the FIG. 27 key may be placed between the symmetrical FIG. 22 keys. The curve of this concave key is identical to the curve of the adjacent key top edges of the FIG. 22 keys. The right-facing FIG. 22 key may be assigned to F#, the concave key to G#, and the FIG. 22 key to A#. With this arrangement, the three adjacent black keys are elegantly related to each other in shape. Also, the lack of upwardly-extending features (such as the upwardly curving side of the FIG. 23 key) enables the fingertip to slip onto these keys from the row above without impediment. Furthermore, with all side edges congruent with side edges of adjacent keys, glissandos may be performed smoothly as well.

A similar arrangement assigns the FIG. 22 key to F#, the FIG. 27 key to G#, and the right-facing FIG. 22 key to A#. An advantage of this arrangement is that the three adjacent black keys are thus raised relative to the other keys. This facilitates learning since these keys on a conventional keyboard are raised also.

The preferred embodiments disclosed in this specification are not intended to limit the scope of the invention.

I claim:

1. A key in a keyboard of a finger-operated device comprising, a key top, a substantially planar surface on said key top, a side surface, and a ridge extending longitudinally along at least a portion of said key top substantially adjacent said side surface wherein, said planar surface extends substantially from the rear end of said key top to the front edge of said key top.

2. A key as in claim 1 further comprising, a second ridge, symmetrical with said first ridge, on said key top opposite said first ridge.

3. A key in a keyboard of a finger-operated device comprising, a key top, at least one ridge extending longitudinally on said key top, and an area of said key top aligned with said ridge adjacent the front edge where in, said ridge in said area is at least reduced in height.

4. A key as in claim 3 further comprising, a second ridge, symmetrical with said first ridge, on said key top opposite said first ridge.

5. A key as in claim 3 wherein, the portion of said key top rearward of said front area is substantially covered with a multiplicity of substantially uniformly spaced longitudinal ridges.

6. A key in a keyboard of a firmer-operated device comprising, a key top, at least one ridge on the right side of said key top extending forward longitudinally from the rear end of said key top to a first longitudinal position on said key top, said first longitudinal position located a substantial distance from both the front and rear ends of said key top, said right side ridge turning rightward forward of said first longitudinal position, and, at least one ridge on the left side of said key top extending forward longitudinally from the rear end of said key top to a second longitudinal position on said key top, said second longitudinal position located a substantial distance from both the front and rear ends of said key top, said left side ridge turning leftward forward of said second longitudinal position.

7. A key top as in claim 6 wherein, said first and second longitudinal positions are substantially the same distance from the rear end of said key.

8. A key top as in claim 6 further comprising, at least one peak-shaped ridge in the front center portion of said key top.

9. A key in a keyboard of a finger-operated device comprising, a key top, a substantially flat section extending longitudinally along the center of said key top, a longitudinal slot on one side of said key top and, a longitudinal ridge on the key top adjacent the bottom of said slot wherein, said slot is disposed between said ridge and said flat section.

10. A key as in claim 9 further comprising,

A second slot and ridge on the other side of the key top.

11. A key in a keyboard for a finger-operated device comprising, a key top, a side surface, a first ridge incorporating a rounded top edge extending longitudinally along at least a portion of said key top substantially adjacent said side surface, and, a second ridge, symmetrical with said first ridge, on said key top opposite said first ridge.

12. A keyboard for a musical instrument comprising, a first key, said first key incorporating a key top, said first key top incorporating a tactile pattern wherein, said first tactile pattern includes surface angles of 45 degrees from vertical;

a second key, said second key incorporating a key top, said second key top incorporating a tactile pattern wherein, all surface angles of said second tactile pattern are 30 degrees from horizontal or less; and, a third key, said third key incorporating a flat key top.

13. A keyboard as in claim 12 wherein, said second tactile pattern comprises knobs.

14. A keyboard as in claim 12 wherein, said second tactile pattern comprises craters.

15. A keyboard as in claim 12 wherein, said second tactile pattern comprises ridges.

16. A keyboard as in claim 12 wherein, said second tactile pattern comprises slots.

17. A key in a keyboard for a musical instrument comprising:

a key top, a side surface, and a section of said key top extending along the front-rear axis of said keyboard substantially adjacent said side surface wherein;

said key top section includes at least two height variations along the front-rear axis of said keyboard, and said key top section comprises a row of features selected from the group consisting of knobs, craters, and ridges, said ridges extending along the left to right axis.

* * * * *